US008816658B1

(12) United States Patent
De Vita et al.

(10) Patent No.: US 8,816,658 B1
(45) Date of Patent: Aug. 26, 2014

(54) LOW-DROPOUT CONVERTERS WITH FEEDBACK COMPENSATION

(75) Inventors: Guiseppe De Vita, Pavia (IT); Shafiq M. Jamal, Gilroy, CA (US)

(73) Assignee: Marvell International Ltd., Hamilton (BM)

( * ) Notice: Subject to any disclaimer, the term of this patent is extended or adjusted under 35 U.S.C. 154(b) by 1005 days.

(21) Appl. No.: 12/204,316

(22) Filed: Sep. 4, 2008

Related U.S. Application Data

(60) Provisional application No. 60/969,800, filed on Sep. 4, 2007.

(51) Int. Cl.
*G05F 1/565* (2006.01)

(52) U.S. Cl.
USPC ..... 323/275

(58) Field of Classification Search
USPC ..... 323/273–281, 234, 237, 265, 282, 284, 323/285
See application file for complete search history.

(56) References Cited

U.S. PATENT DOCUMENTS

| | | | | |
|---|---|---|---|---|
| 6,509,722 | B2 * | 1/2003 | Lopata | 323/280 |
| 6,603,292 | B1 * | 8/2003 | Schouten et al. | 323/277 |
| 7,288,978 | B2 * | 10/2007 | Suzuki et al. | 327/261 |
| 7,622,991 | B2 * | 11/2009 | Sauer | 330/256 |
| 2002/0105382 | A1 * | 8/2002 | Kadanka | 330/292 |
| 2004/0051508 | A1 * | 3/2004 | Hamon et al. | 323/280 |
| 2007/0159146 | A1 | 7/2007 | Mandal | |
| 2007/0257732 | A1 | 11/2007 | Farrar et al. | |
| 2008/0088286 | A1 * | 4/2008 | Cho et al. | 323/280 |
| 2008/0211313 | A1 * | 9/2008 | Nakamura | 307/75 |
| 2009/0021251 | A1 * | 1/2009 | Simon | 324/233 |
| 2009/0079406 | A1 * | 3/2009 | Deng et al. | 323/280 |

* cited by examiner

*Primary Examiner* — Adolf Berhane
*Assistant Examiner* — Jeffrey Gblende

(57) ABSTRACT

A low-dropout converter includes a capacitor and a resistor. The resistor is coupled to the capacitor. The resistor includes a fixed resistor and at least one variable resistor. The capacitor and the resistor determine the location of a zero of the transfer function of the low-dropout converter.

42 Claims, 11 Drawing Sheets

LOW-DROPOUT CONVERTERS WITH FEEDBACK COMPENSATION

CROSS-REFERENCE TO RELATED APPLICATIONS

This application claims priority to, and incorporates by reference, U.S. Provisional Patent Application Ser. No. 60/969,800, filed on Sep. 4, 2007, titled "LDO Compensation."

TECHNICAL FIELD

The disclosed concepts relate generally to electronic apparatus and, more particularly, to a voltage-regulator apparatus with compensation, and associated methods.

BACKGROUND

The advances in electronic circuitry and semiconductor fabrication technologies have resulted in physically smaller electronic components. In addition, the level of integration has continued to rise, further decreasing the size of electronic components, while increasing their functionality.

Both of the above developments have enabled the proliferation of hand-held devices, such as digital cameras, mobile handsets, personal digital assistants (PDAs), and the like. Those devices typically operate from a battery, the voltage of which may often not match the operating voltage(s) of the electronic components of the devices. Voltage regulators convert the battery voltage to voltages appropriate for operating the electronic circuitry.

SUMMARY

The disclosed concepts relate to compensating power converters. More specifically, the disclosed concepts relate to compensating the transfer function of power converters, such as low-dropout (LDO) converters.

In one exemplary embodiment, a low-dropout converter includes a capacitor and a resistor. The resistor is coupled to the capacitor. The resistor includes a fixed resistor and at least one variable resistor. The capacitor and the resistor determine the location of a zero of the transfer function of the low-dropout converter.

In another exemplary embodiment, a power converter includes a plurality of variable resistors used to compensate the transfer function of the power converter. The resistance of each variable resistor in the plurality of variable resistors varies as a function of the output current of the power converter.

In yet another exemplary embodiment, a method of compensating a transfer function of a power converter includes obtaining a plurality of samples of the output current of the power converter. The method further includes using the plurality of samples of the output current of the power converter to compensate the transfer function of the power converter.

BRIEF DESCRIPTION OF THE DRAWINGS

The appended drawings illustrate only exemplary embodiments and therefore should not be considered as limiting its scope. Persons of ordinary skill in the art who have, the benefit of this disclosure appreciate that the disclosed concepts lend themselves to other equally effective embodiments. In the drawings, the same numeral designators used in more than one drawing denote the same, similar, or equivalent functionality, components, or blocks.

DETAILED DESCRIPTION

The disclosed concepts relate generally to power conversion circuitry and methods. More specifically, the disclosed concepts provide apparatus and methods for compensated low-dropout (LDO) voltage regulators (or LDOs). The LDO regulators or LDOs convert an input voltage, such as the voltage from a battery, to one or more voltages appropriate for operating one or more electronic circuits, such as integrated circuits (ICs).

Figure 1:
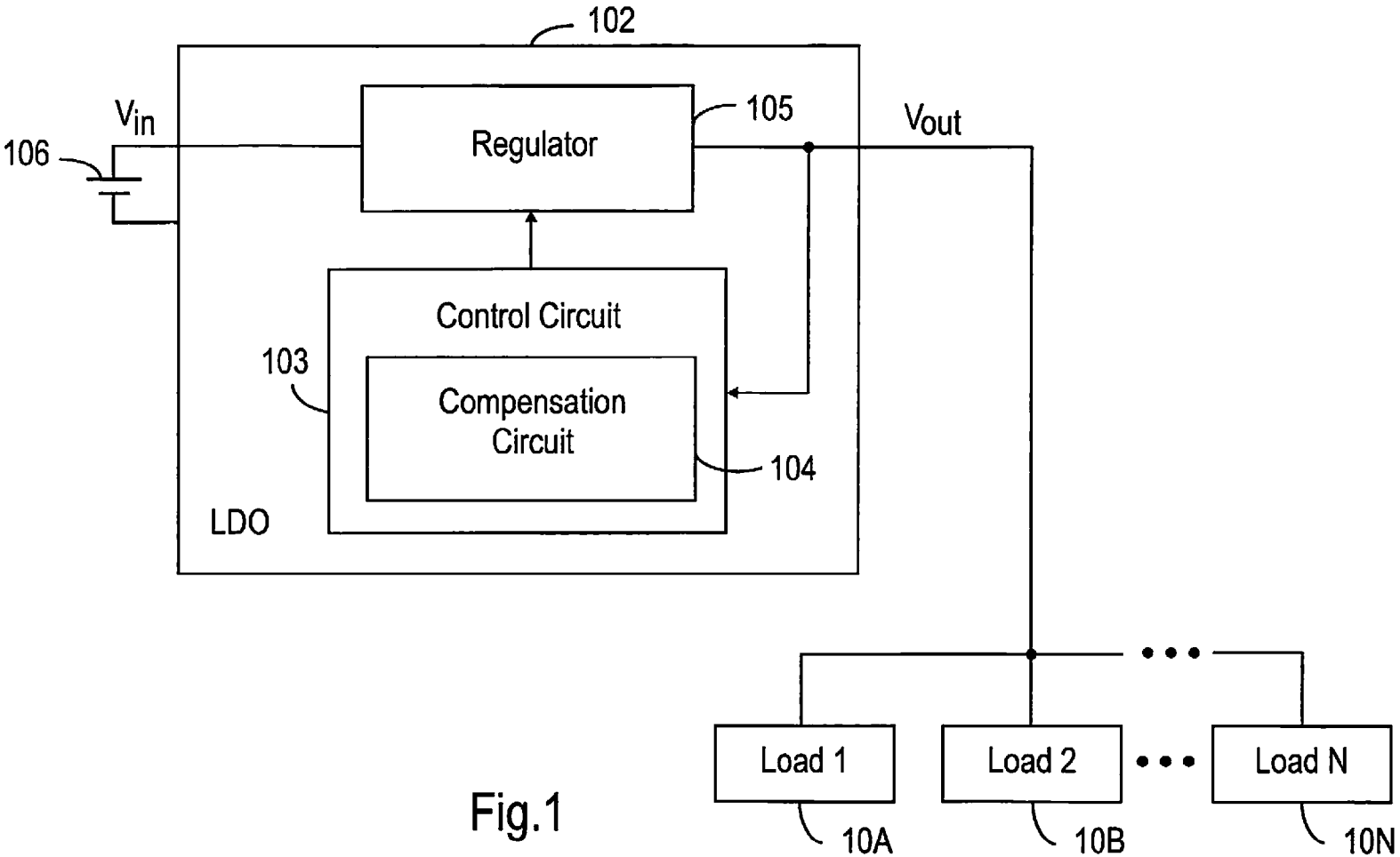
FIG. 1 illustrates a simplified block diagram of a low-dropout (LDO) regulator according to an exemplary embodiment.

FIG. 1 illustrates a simplified block diagram of an LDO regulator (or LDO) 102 according to an exemplary embodiment. LDO 102 includes control circuit 103 and regulator 105.

LDO 102 accepts as an input voltage ($V_{in}$) the output voltage of battery 106 (or some other appropriate power source). At its output, LDO 102 generates an output voltage ($V_{out}$). LDO 102 supplies the output voltage to one or more loads, designated as 10A-10N (i.e., the blocks labeled as "Load1," "Load 2," and so on, to "Load N").

Regulator 105 typically includes a pass transistor and associated circuitry (e.g., driver or buffer circuitry). Control circuit 103 provides one or more control signals to regulator 105. Control circuit 103 derives the control signal(s) as a function of the output voltage.

Put another way, control circuit 103 operates in a feedback loop. Control circuit 103 samples the output voltage of LDO 102 and, based on comparison of the sampled output voltage with a reference voltage, generates an error signal. Control circuit 103 derives the control signal(s) from the error signal.

Compensation circuit 104 (described below in detail) helps to maintain the stability of LDO 102. More specifically, as noted above, LDO 102 uses a negative feedback circuit to regulate the output voltage. Compensation circuit 104 helps to ensure that LDO 102 operates in a stable manner, and that it does not suffer from oscillations that render unstable the operation of LDO 102.

Note that, rather than regulating a voltage, one may regulate a current, or both a current or a voltage, as persons of ordinary skill in the art who have the benefit of the description of the disclosed concepts understand. Thus, one may generate a regulated output current, and provide that current to loads 10A-10N.

One may use compensated LDOs according to the disclosed concepts in a variety of applications, as desired. For example, as FIGS. 2 and 3 illustrate, respectively, one may use the compensated LDOs in mobile handsets or devices and digital cameras.

Figure 2:
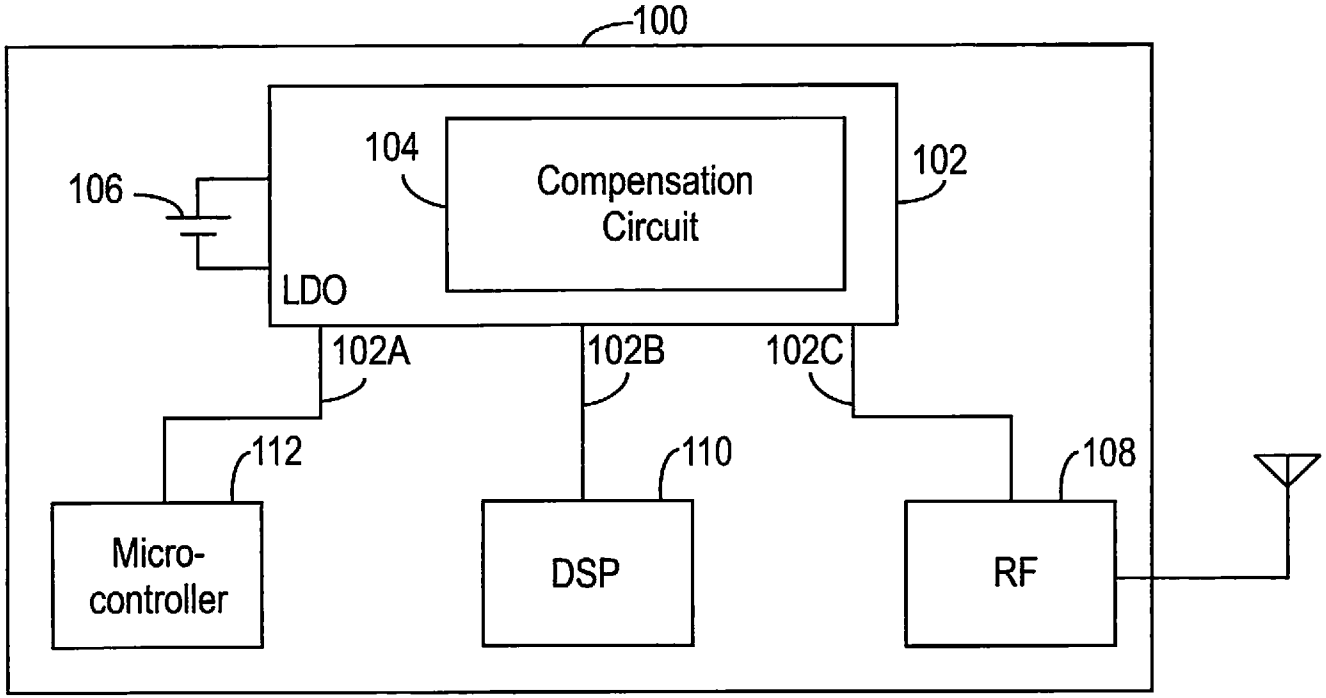
FIG. 2 depicts a simplified block diagram of a mobile device that uses a compensated LDO according to an exemplary embodiment.
Figure 3:
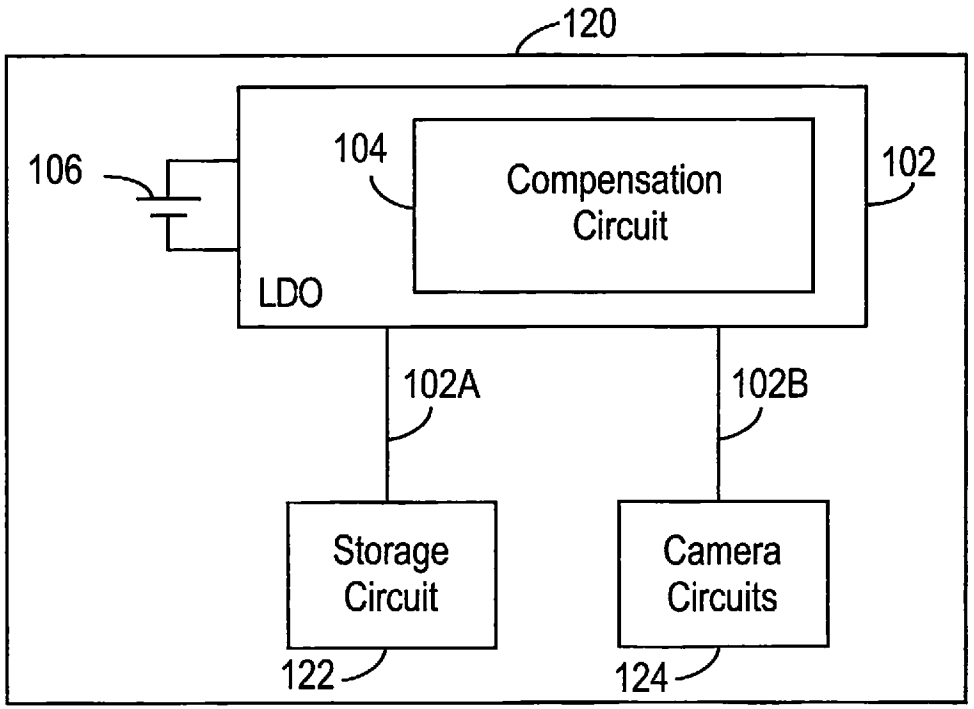
FIG. 3 shows a simplified block diagram of a digital camera that uses a compensated LDO according to an exemplary embodiment.

FIG. 2 depicts a simplified block diagram of a mobile device 100 that uses a compensated LDO according to an exemplary embodiment. Mobile handset 100 may constitute a mobile radio, such as a cellular device, personal digital assistant (PDA), and the like, as persons of ordinary skill in the art who have the benefit of the description of the disclosed concepts understand.

Mobile device 100 includes LDO 102, which includes compensation circuit 104. Mobile device 102 also includes radio-frequency (RF) circuitry 108, digital signal processor (DSP) 110, and microcontroller 112. RF circuitry 108 may constitute or include a transmitter, a receiver, or both (i.e., a transceiver). DSP 110 and microcontroller 112 provide various functionality of mobile device 100 (e.g., modulation, demodulation, coding, audio, etc.), as persons of ordinary skill in the art who have the benefit of the description of the disclosed concepts understand.

Battery 106 provides power for mobile device 100. Typically, battery 106 has a higher output voltage than the operating voltages of the various circuits in mobile device 100. LDO 102 converts the output voltage of battery 106 to one or more appropriate output voltages (denoted as 102A-102C), and provides those voltages to various circuits in mobile device 100, for example, RF circuitry 108, DSP 110, and microcontroller 112.

As noted above, LDO 102 uses a negative feedback loop to regulate or control the output voltage(s) 102A-102C. Compensation circuit 104 helps to maintain stability of the feedback loop and, thus, the stability of LDO 102.

FIG. 3 depicts a simplified block diagram of a digital camera 120 that uses a compensated LDO according to an exemplary embodiment. Digital camera 120 may constitute a portable camera, video camera, video recorder, and the like, as persons of ordinary skill in the art who have the benefit of the description of the disclosed concepts understand.

Digital camera 120 includes LDO 102, which includes compensation circuit 104. Digital camera 120 also includes storage circuit 122 and camera circuits 124. Storage circuit 122 provides storage for images or video captured by digital camera 120. For example, storage circuit 102A may include flash memory.

Camera circuits 124 include other circuitry to facilitate the functionality of digital camera 120. For example, camera circuits 124 might include control circuitry, exposure circuitry, auto-focus circuitry, zoom circuitry, and the like, as persons of ordinary skill in the art who have the benefit of the description of the disclosed concepts understand.

Battery 106 provides power for digital camera 120. Typically, battery 106 has a higher output voltage than the operating voltages of the various circuitry in digital camera 120. LDO 102 converts the output voltage of battery 106 to one or more appropriate output voltages (denoted as 102A-102B), and provides those voltages to various circuits in digital camera 120, for example, storage circuit 122 and camera circuits 124.

As noted above, LDO 102 uses a negative feedback loop to regulate or control the output voltage(s) 102A-102B. Compensation circuit 104 helps to maintain stability of the feedback loop and, thus, the stability of LDO 102.

Note that mobile device 100 and digital camera 120 merely constitute exemplary embodiments of electronic device that include compensated LDOs according to the disclosed concepts. Thus, one may use compensated LDOs in a wide variety of electronic devices and circuits, as persons of ordinary skill in the art who have the benefit of the description of the disclosed concepts understand.

Figure 4:
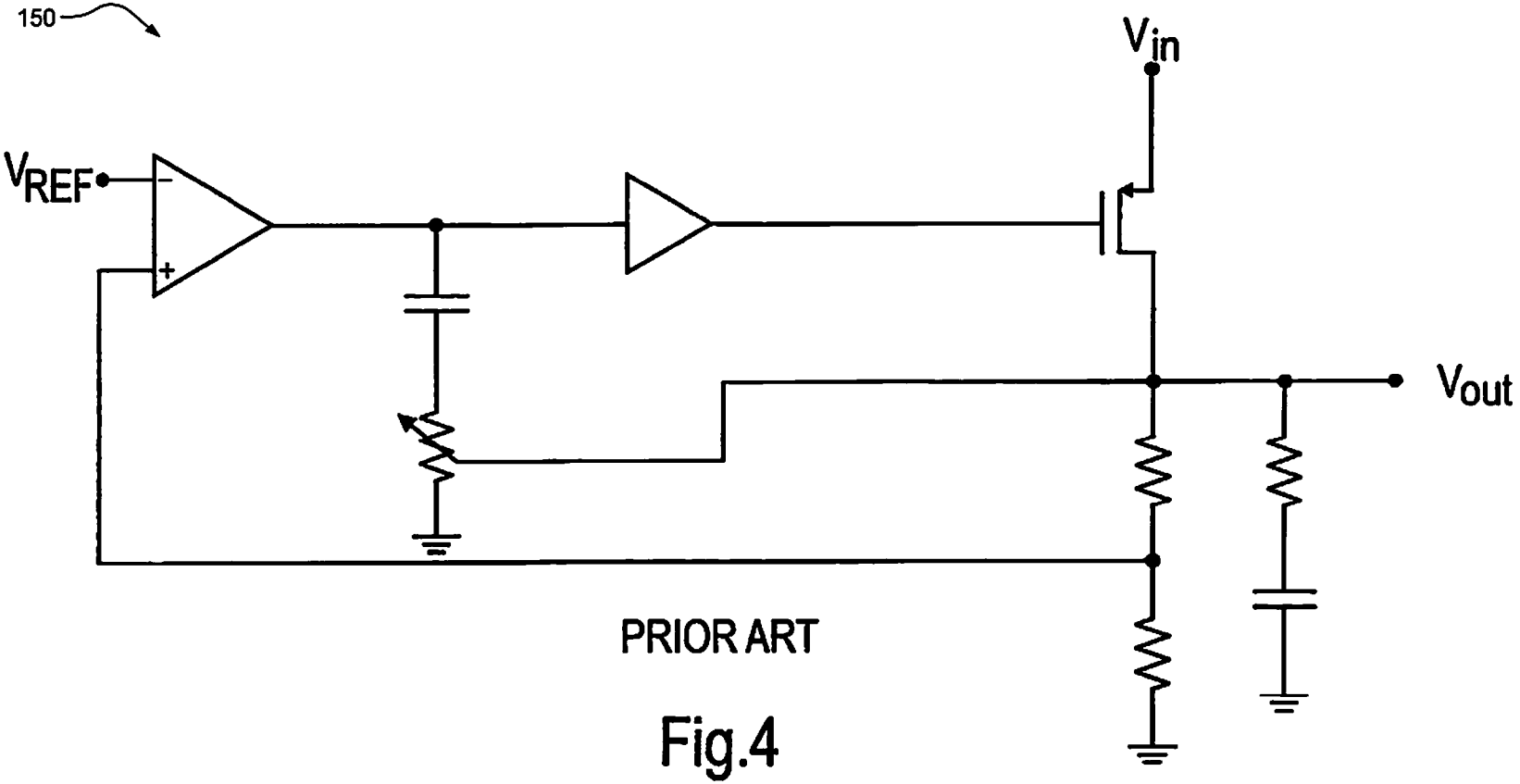
PRIOR ART Fig.4
FIG. 4 shows a conventional scheme for LDO compensation.
Figure 5:
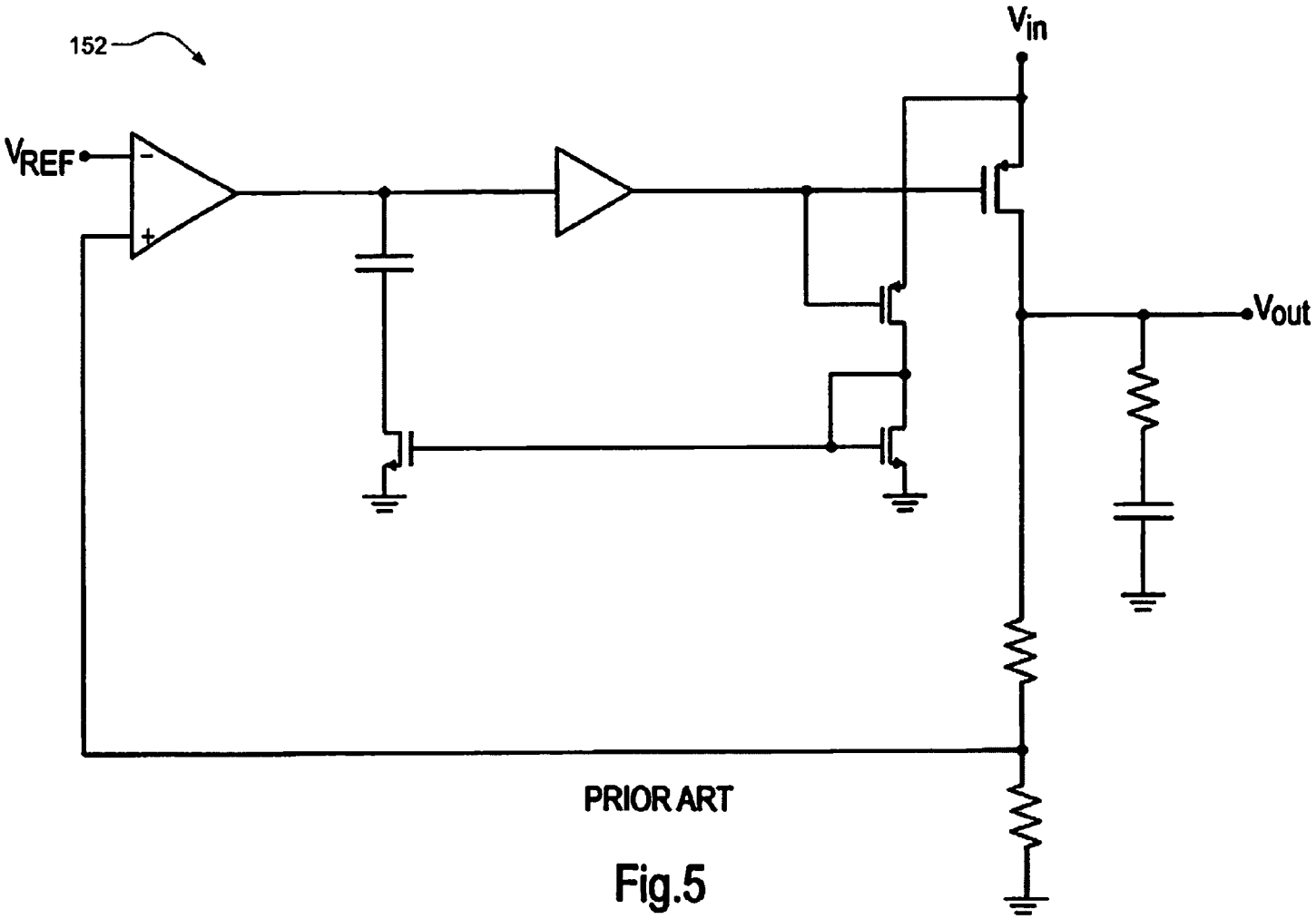
PRIOR ART Fig.5
FIG. 5 illustrates another conventional scheme for LDO compensation.

Conventional schemes for LDO compensation use the techniques shown in FIGS. 4 and 5. More specifically, FIGS. 4 and 5 show LDO circuits 150, 152 that employ an internal zero that tracks the output pole. The details of the LDO circuits 150, 152 and operation of the LDO circuits 150, 152 in FIGS. 4 and 5 fall within the knowledge of persons of ordinary skill in the art.

Figure 6:
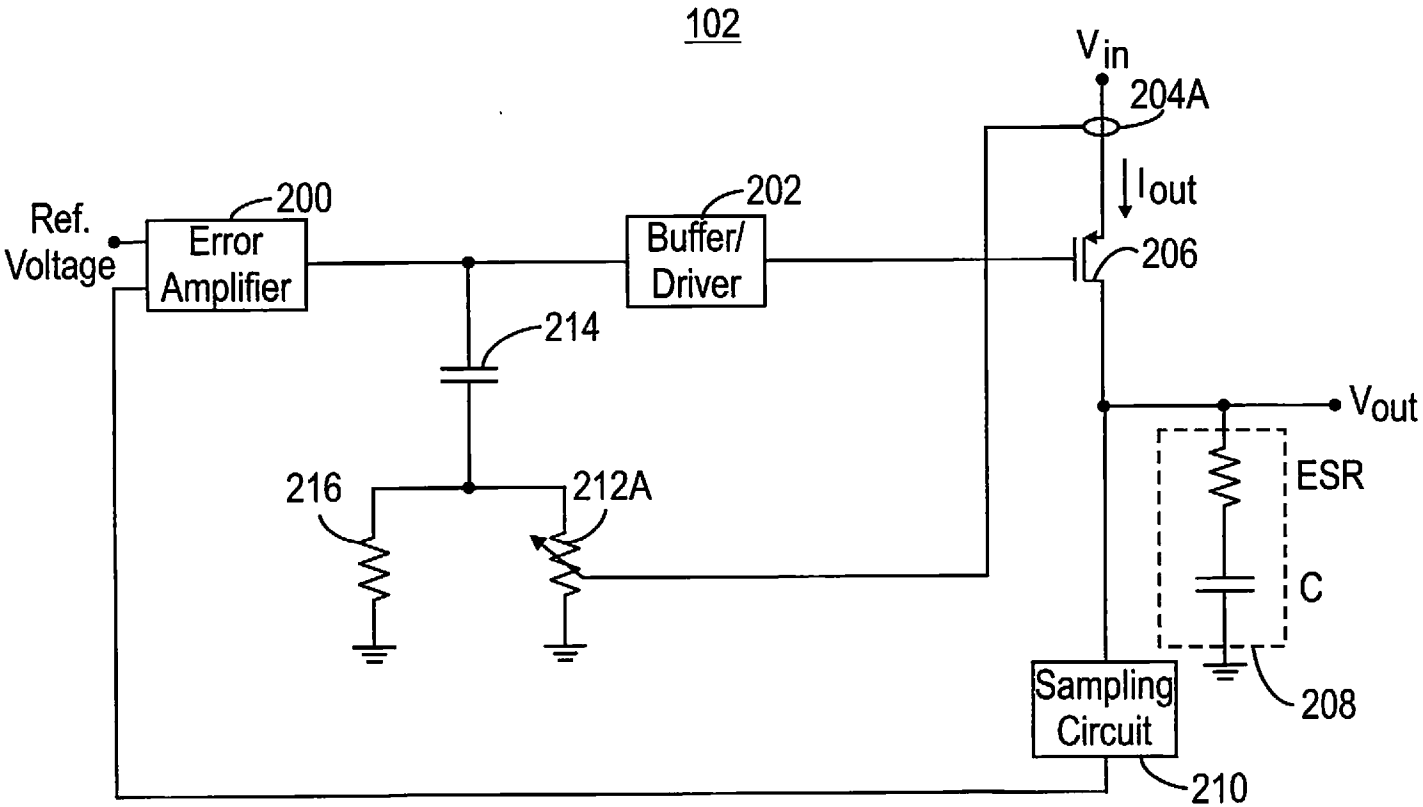
FIG. 6 depicts a simplified block diagram of a compensated LDO 102 according to an exemplary embodiment.

FIG. 6 depicts a simplified block diagram of a compensated LDO 102 according to an exemplary embodiment. LDO 102 includes error amplifier 200, buffer/driver 202, current sensor 204A, pass transistor 206, output capacitor 208, sampling circuit 210, variable resistor 212A, capacitor 214, and resistor 216.

Under the control of error amplifier 200 (described below in detail), pass transistor 206 converts the input voltage $V_{in}$ to output voltage $V_{out}$. A battery or other source (not shown explicitly) may provide input voltage $V_{in}$. LDO 102 supplies the output voltage $V_{out}$. to one or more desired loads (not shown explicitly).

In the embodiment shown, the particular configuration of pass transistor 206 (the source terminal coupled to the input voltage, and the drain terminal coupled to the load) provides the capability of providing an output voltage that differs from an input voltage by a relatively small value (e.g., several hundred milli-Volts). Note, however, that one may use other pass-transistor configurations (e.g., a source-follower configuration), as persons of ordinary skill in the art who have the benefit of the description of the disclosed concepts understand.

Sampling circuit 210 samples output voltage $V_{out}$, and provides a sample to error amplifier 200. One may use a variety of configurations for sampling circuit 210, as desired.

Error amplifier 200 compares the sampled output voltage with a reference voltage (denoted as "Ref. Voltage" in FIG. 6). Based on the comparison, error amplifier 200 provides an error signal to buffer/driver 202.

Buffer/driver 202 buffers the error signal at the output of error amplifier 200, and provides the resulting signal to the gate terminal of pass transistor 206. Depending on factors such as the size of pass transistor 206, buffer/driver 202 may include driver circuitry for transistor 206, as desired, and as persons of ordinary skill in the art who have the benefit of the description of the disclosed concepts understand.

Capacitor 208 filters the output voltage ($V_{out}$). Put another way, it acts as a decoupling capacitor and also filters out ripple voltage, high-frequency variations, etc. Unlike an ideal capacitor, a physical capacitor has parasitic elements, such as a series resistor. Capacitor 208 has a capacitance, labeled as "C," and an equivalent series resistor, labeled as "ESR."

As one may observe by examination of FIG. 6, LDO 102 includes a feedback loop. The feedback loop includes sampling circuit 210, error amplifier 200, and buffer/driver 202. The output signal of the feedback loop (i.e., the output signal of buffer/driver 202) drives the gate terminal of pass transistor 206. The signal at the drain terminal of transistor 206 (i.e., signal $V_{out}$) couples to, and drives, the input of sampling circuit 210.

The transfer function of LDO 102 includes three poles. The location of the first pole, or the output pole, depends on the capacitance (C) of capacitor 208 and the output resistance ($R_{out}$) of LDO 102. The output resistance of LDO 102 constitutes the ratio of the output voltage ($V_{out}$) to the output current ($I_{out}$), i.e., $R_{out}=V_{out}/I_{out}$. Thus, the output pole occurs at the frequency $\omega_{out}=1/(C\cdot R_{out})$.

The second pole's location depends on the output resistance of error amplifier 200, $R_{out1}$, and capacitance of capacitor 214, $C_1$. Thus, the pole occurs at a frequency $\omega_1=1/(C_1\cdot R_{out1})$.

The location of the third pole depends on the output resistance of buffer/driver 202, and the capacitance present at the output of buffer/driver 202, $C_2$. In other words, the third pole occurs at a frequency $\omega_2=1/(C_2\cdot R_{out2})$.

The third pole usually occurs at a larger frequency than the unity-gain frequency because the output resistance of buffer/driver 202 has a relatively small value (because buffer/driver 202 has a relatively large drive capability). Thus, the first pole and the second pole dominate the transfer function and the stability of LDO 102.

Conventional LDO compensation schemes use the parasitic resistance of the output filter capacitor to introduce a zero into the LDO's transfer function. The parasitic resistance, however, can vary by relatively large amounts, for example, depending on the type of the capacitor, and capacitor-value tolerances, and the like.

Referring to FIG. 6, to facilitate stable operation of the feedback circuit, LDO 102 includes a compensation network that includes current sensor 204A, resistor 216, resistor 212A, and capacitor 214. The parallel combination of resistor 216 and resistor 212A couples in series to capacitor 214, thus creating a zero in the transfer function of LDO 102.

The location of the zero depends on the output current of LDO 102. Specifically, current sensor 204A senses the output current of LDO 102 (i.e., the source or drain current of transistor 206, assuming a negligible gate leakage current). The value of resistor 212A depends on the output current, i.e., $I_{out}$. Thus, variations in the output current ($I_{out}$) cause variations in the resistance of resistor 212A and, hence, changes in the location of the internal zero in the transfer function.

More specifically, variations in the resistance of resistor 212A cause variations in the overall resistance formed by the parallel combination of resistor 212A and resistor 216, say, $R_{eq1}$. Because the location of the zero depends on the resistance of resistor $R_{eq1}$ and the capacitance of capacitor 214, variations in the output current cause corresponding changes in the location of the zero in the transfer function. The dependence of the location of the internal zero on the magnitude of the output current provides a relatively good phase margin, and improves the stability of LDO 102.

Figure 7:
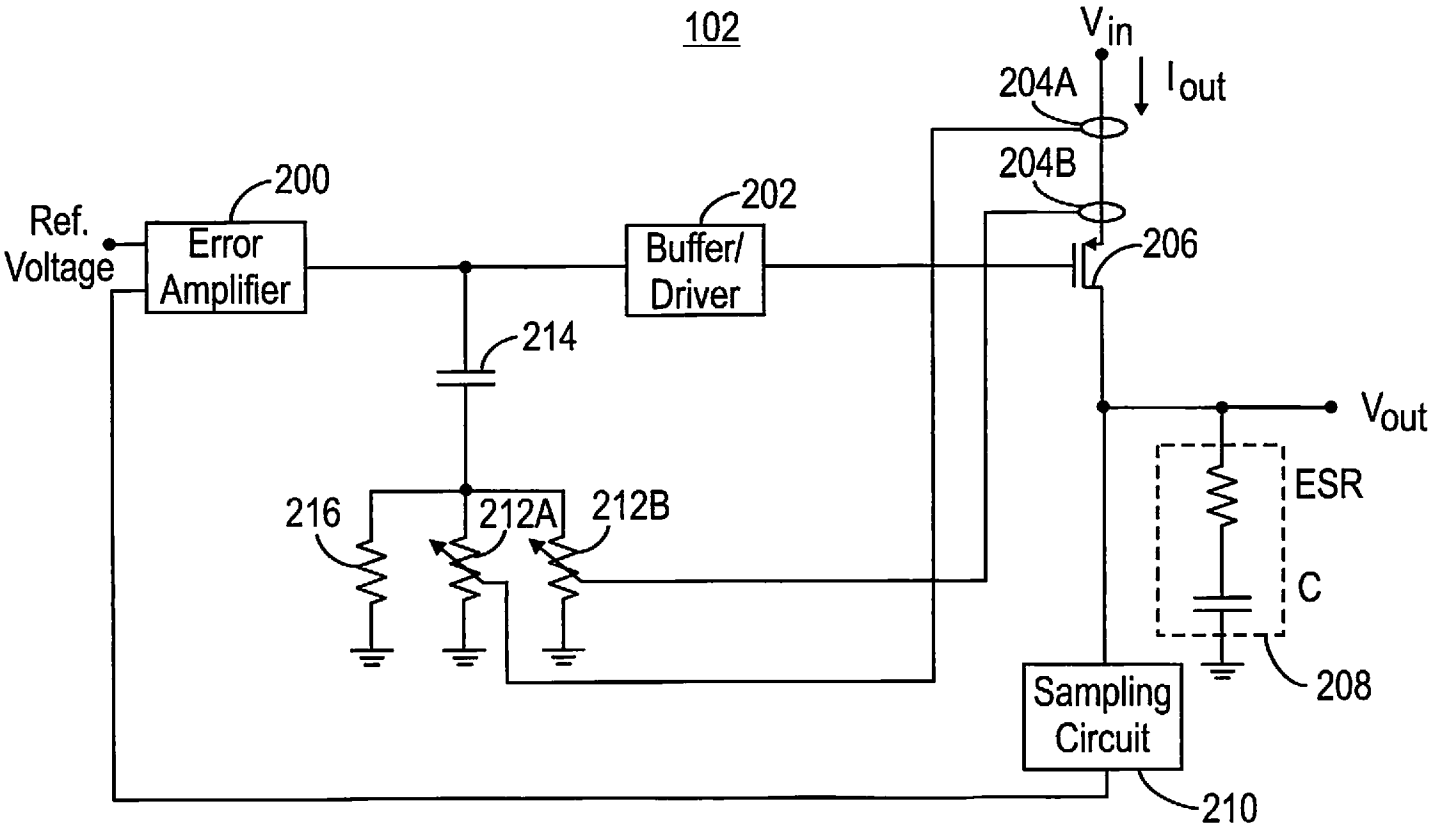
FIG. 7 illustrates a simplified block diagram of a compensated LDO according to another exemplary embodiment.

One may refine the concepts described above by introducing additional variable resistors in LDO 102. FIG. 7 illustrates a simplified block diagram of a compensated LDO 102 according to another exemplary embodiment.

LDO 102 includes error amplifier 200, buffer/driver 202, current sensor 204A, current sensor 204B, pass transistor 206, output capacitor 208, sampling circuit 210, variable resistor 212A, variable resistor 212B, capacitor 214, and resistor 216. Error amplifier 200, buffer/driver 202, pass transistor 206, and output capacitor 208 may have similar circuitry and functionality to their counterparts shown in FIG. 6, and described above.

To facilitate stable operation of the feedback circuit, LDO 102 includes a compensation network that includes current sensors 204A-204B, resistor 216, resistors 212A-212B, and capacitor 214. The parallel combination of resistor 216 and resistors 212A-212B couples in series to capacitor 214, thus creating a zero in the transfer function of LDO 102.

The location of the zero depends on the output current of LDO 102. Specifically, current sensor 204A senses the output current of LDO 102 (i.e., the source or drain current of transistor 206, assuming a negligible gate leakage current). The value of resistor 212A depends on the output current, i.e., $I_{out}$. Thus, variations in the output current ($I_{out}$) cause variations in the resistance of resistor 212A and, hence, changes in the location of the internal zero in the transfer function.

Similarly, current sensor 204B senses the output current of LDO 102. The value of resistor 212B depends on the output current, $I_{out}$. Hence, changes in the output current ($I_{out}$) cause variations in the resistance of resistor 212B and, therefore, variations in the location of the internal zero in the transfer function.

More specifically, variations in the resistances of resistors 212A and 212B cause variations in the overall resistance formed by the parallel combination of resistors 212A-212B and resistor 216, say, $R_{eq2}$. Because the location of the zero depends on the resistance of resistor $R_{eq2}$ and the capacitance of capacitor 214, variations in the output current cause corresponding changes in the location of the zero in the transfer function. The dependence of the location of the internal zero on the magnitude of the output current provides a relatively good phase margin, and improves the stability of LDO 102.

One may scale the sensed currents provided by current sensors 204A-204B, as desired. Thus, one may employ different values of gain or scaling in current sensors 204A-204B. In addition, or in the alternative, one may use different amounts of change in the resistances of resistors 212A-212B in response to the current sensed by, respectively, current sensors 204A-204B. In this manner, one may use a flexible technique to compensate LDO 102 and provide a desired degree of phase margin.

Depending on factors such as the operating environment of the LDO, design or performance specifications, and the like, one may further refine the LDO compensation scheme described above. Specifically, one may use N current sensors to control the resistance of N resistors whose values influence the location of the internal zero in the transfer function of LDOs according to the disclosed concepts. Put another way, one may generalize the compensation scheme illustrated in FIGS. 6 and 7 by employing N current sensors and N variable resistors, where N constitutes a positive integer greater than two.

Figure 8:
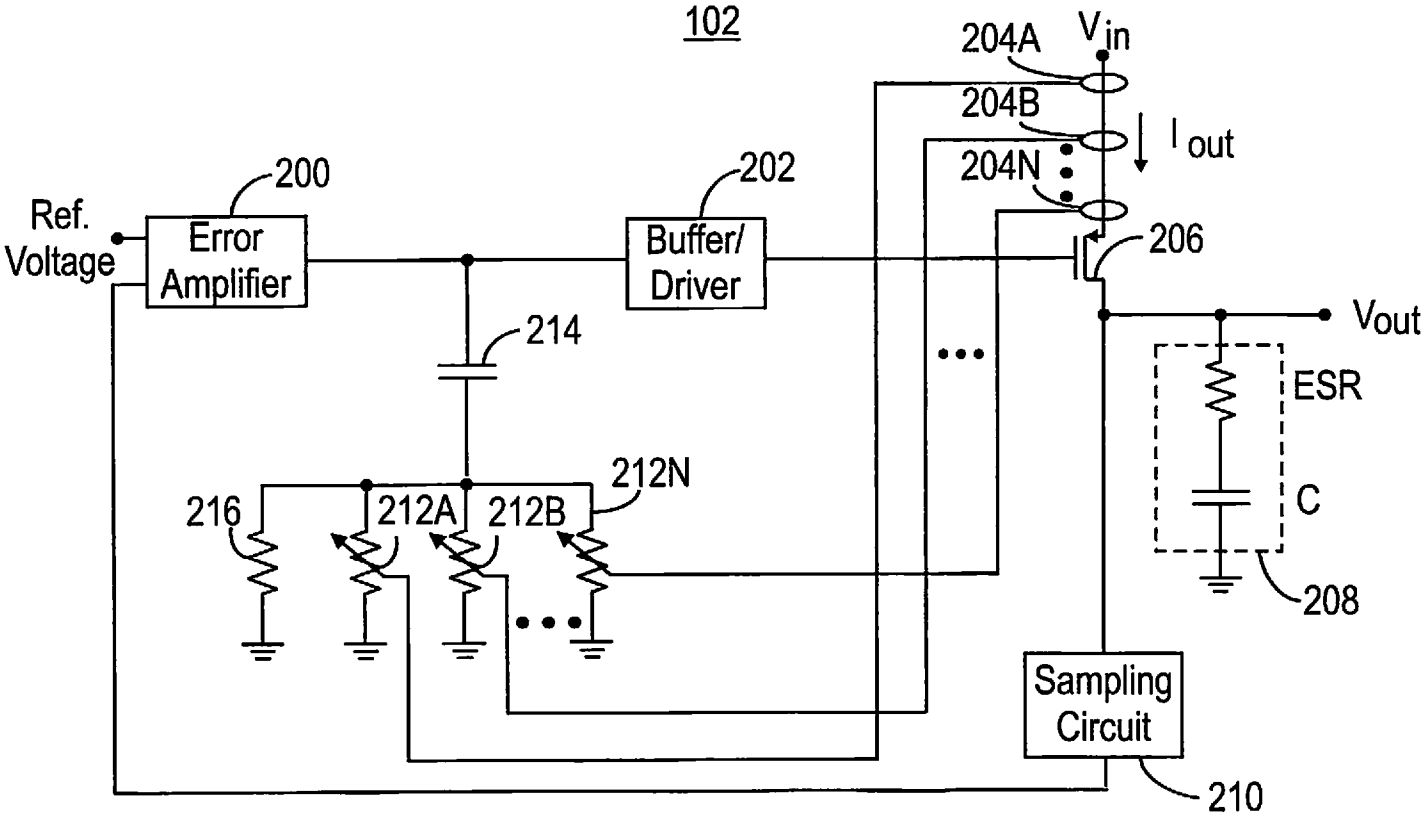
FIG. 8 shows a simplified block diagram of a compensated LDO according to an additional exemplary embodiment.

FIG. 8 shows a simplified block diagram of a compensated LDO 102 according to an additional exemplary embodiment. In this embodiment, one may implement the internal zero by using a fixed resistor and N variable resistors (or N variable resistors, as desired, by omitting the fixed resistor).

Specifically, LDO 102 includes error amplifier 200, buffer/driver 202, current sensors 204A-204N, pass transistor 206, output capacitor 208, sampling circuit 210, variable resistors 212A-212N, capacitor 214, and resistor 216. Error amplifier 200, buffer/driver 202, pass transistor 206, and output capacitor 208 may have similar circuitry and functionality to their counterparts shown in FIGS. 6 and 7, and described above.

To facilitate stable operation of the feedback circuit, LDO 102 includes a compensation network that includes current sensors 204A-204N, resistor 216, resistors 212A-212N, and capacitor 214. The parallel combination of resistor 216 and resistors 212A-212N couples in series to capacitor 214, thus creating a zero in the transfer function of LDO 102.

The location of the zero depends on the output current of LDO 102. Specifically, current sensor 204A senses the output current of LDO 102 (i.e., the source or drain current of transistor 206, assuming a negligible gate leakage current). The value of resistor 212A depends on the output current, i.e., $I_{out}$. Thus, variations in the output current ($I_{out}$) cause variations in the resistance of resistor 212A and, hence, changes in the location of the internal zero in the transfer function.

Similarly, each of current sensors 204B-204N senses the output current of LDO 102. The value of each of resistors 212B-212N depends on the output current, $I_{out}$. Hence, changes in the output current ($I_{out}$) cause variations in the resistance of resistors 212B-212N and, therefore, variations in the location of the internal zero in the transfer function.

More specifically, variations in the resistances of resistors 212A-212N cause variations in the overall resistance formed by the parallel combination of resistors 212A-212N and resistor 216, say, $R_{eqN}$. Because the location of the zero depends on the resistance of resistor $R_{eqN}$ and the capacitance of capacitor 214, variations in the output current cause corresponding changes in the location of the zero in the transfer function. The dependence of the location of the internal zero on the magnitude of the output current provides a relatively good phase margin, and improves the stability of LDO 102.

Similar to the LDO shown in FIG. 7, one may scale the sensed currents provided by current sensors 204A-204N, as desired. Thus, one may employ different values of gain or scaling in current sensors 204A-204N. In addition, or instead, one may use different amounts of change in the resistances of resistors 212A-212N in response to the current sensed by, respectively, current sensors 204A-204N. In this manner, one may use a flexible technique to compensate LDO 102 and provide a desired degree of phase margin.

Figure 9:
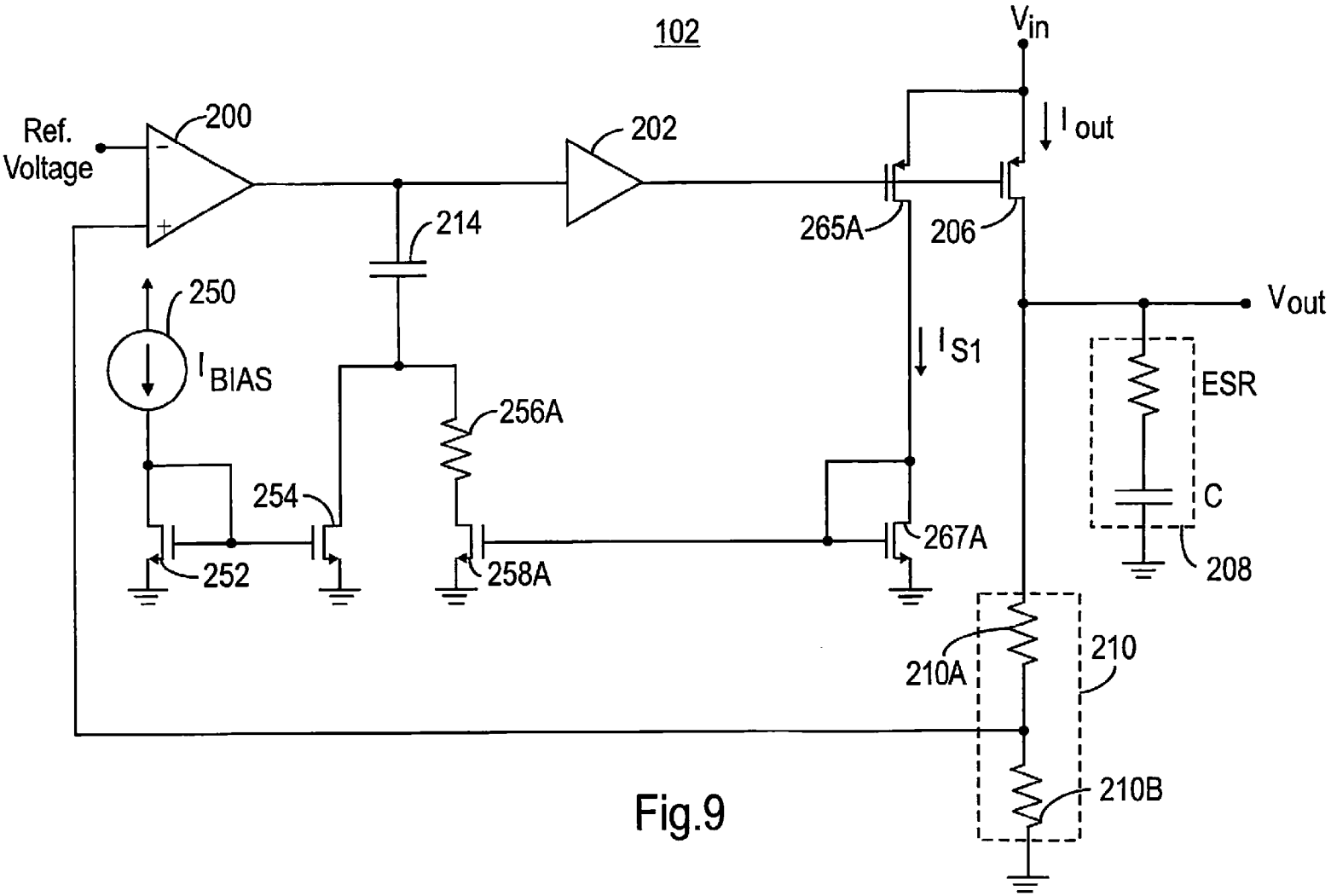
FIG. 9 illustrates a more detailed circuit schematic of the LDO shown in FIG. 6.

FIG. 9 illustrates a more detailed circuit schematic of LDO 102 shown in FIG. 6. LDO 102 includes error amplifier 200, buffer/driver 202, pass transistor 206, output capacitor 208, sampling circuit 210, and capacitor 214.

Sampling circuit 210 includes resistors 210A-210B, arranged as a resistor divider. Assuming a relatively close match between the resistors, the resistor divider provides relatively immunity to temperature changes.

Put another way, given a relatively close temperature coefficient of resistors 210A-210B, the values of resistors 210A-210B vary uniformly (or substantially uniformly) with temperature. As a result, the sample voltage provided to error amplifier 200 remains independent (or substantially independent) of temperature variations.

One may use a variety of circuits to implement error amplifier 200. As one example, one may use a comparator. As another example, one may use an operational amplifier.

Transistor 265A and transistor 267A form a current sensor. Specifically, a scaled version, $I_{S1}$, of the output current ($I_{out}$) flows through transistor 265A and transistor 267A. Note that the output voltage of buffer/driver 202 drives the gate terminals of both transistor 265A and transistor 206. Note further that the source terminals of both transistor 265A and transistor 206 couples to the input voltage ($V_{in}$).

Put another way, transistor 265A and transistor 206 have the same gate-source or drive voltage. Consequently, transistor 265A and transistor 206 have the same drain current, except as scaled by the relative sizes of the two transistors. As a result, the current flowing through transistor 265A (i.e., $I_{S1}$) is a scaled version of the current flowing through transistor 206 (i.e., $I_{out}$).

Diode-connected transistor 267A conducts the same current as transistor 265A, i.e., $I_{S1}$. Transistor 265A and transistor 258A have the same gate-source voltage. Transistors 267A and 258A function as a current mirror. Little or no current flows through transistor 258A because transistor 258A operates with a drain-source voltage of approximately zero.

From a functional perspective, variations in the output current ($I_{out}$) cause corresponding variations in the current conducted by transistor 267A (Is1) and then in the gate-source voltage of transistor 258A. Thus, variations in the output current cause changes in the effective resistance of transistor 258A (the resistance between the source and drain terminals). Consequently, the series resistance of resistor 256A and the effective resistance of transistor 258A changes in response to variations in the output current.

Transistor 252 and transistor 254 form a current mirror. Current source 250 provides a constant current, $I_{BIAS}$, to diode-connected transistor 252. Transistor 252 and transistor 254 have approximately the same gate-source voltage and transistor 254 conducts little or no current. Consequently, the effective resistance of transistor 254 (the resistance between the source and drain terminals) constitutes a constant or substantially constant value, similar to resistor 216 in FIG. 6.

The transfer function of LDO 102 has an internal zero whose location depends on a resistance, $R_{eq}$, which constitutes the parallel resistance of: (a) the effective resistance of transistor 254; and (b) the resistance of the series combination of resistor 256A and the effective resistance of transistor 258A. Furthermore, the location of the zero depends on the capacitance of capacitor 214. As noted above, the effective resistance of transistor 258A depends on the output current ($I_{out}$). Consequently, variations in the output current cause changes in the location of the internal zero, thus helping to maintain stability of LDO 102.

For low output currents, the sensed current ($I_{S1}$) has a comparatively small value. As a result, transistor 267A and transistor 258A have relatively small gate-source voltages, which cause them to turn off. Because transistor 267A and transistor 258A conduct zero or nearly zero current, they have relatively high effective resistances.

Consequently, the effective resistance of transistor 252 (for example, 600 kΩ in one illustrative embodiment) controls the value of resistance $R_{eq}$. Because current $I_{BIAS}$ is independent of the output current ($I_{out}$), the location of the internal zero is independent or substantially independent of the output current. The effective resistance of transistor 252 provides appropriate phase margin for this situation, i.e., for low or very low output currents.

For somewhat larger output currents (medium output currents), current $I_{S1}$ has a sufficiently large value to turn on transistor 267A and transistor 258A. In this situation, the series combination of resistor 256A and the effective resistance of transistor 258A is relatively small compared to the effective resistance of transistor 254. As a result, the series combination of resistor 256A and the effective resistance of transistor 258A dominates the resistance $R_{eq}$.

Furthermore, the effective resistance of transistor 258A is large compared to the resistance of resistor 256A. Thus, the effective resistance of transistor 258A dominates the resistance $R_{eq}$ and, hence, the location of the internal zero. In this case, one selects the dimensions of transistor 258A so as to provide a desired or appropriate location for the internal zero and, therefore, desired or appropriate phase margin.

Now consider intermediate output currents ($I_{out}$) between the low and medium currents. In this situation, the value of resistance $R_{eq}$, and therefore the location of the internal zero, falls between its value in the low output current and medium output current cases. Thus, LDO 102 will once again have appropriate phase margin that facilitates its stable operation.

Next, consider relatively high output currents ($I_{out}$). In this situation, transistor 267A and transistor 258A conduct sufficient amounts of current to make the effective resistance of transistor 258A low in comparison to the resistance of resistor 256A. As a result, the resistance of resistor 256A dominates the value of resistance $R_{eq}$, and therefore the location of the internal zero. By selecting an appropriate resistance for resistor 256A, one may provide a desired or appropriate location for the internal zero and, therefore, desired or appropriate phase margin.

Finally, for intermediate output currents ($I_{out}$) between the medium and high, the value of resistance $R_{eq}$, and therefore the location of the internal zero, falls between its value in the medium output current and high output current cases. Thus, LDO 102 will once again have appropriate phase margin that facilitates its stable operation.

Overall, the embodiment in FIG. 9 (or the embodiment in FIG. 6) divides the output current ($I_{out}$) into three ranges or values (low, medium, and high). For each range or value, and for intermediate ranges or values, one may select the dimensions or values of the circuit components so as to provide a desired or appropriate phase margin, and facilitate stable operation of LDO 102.

Figure 10:
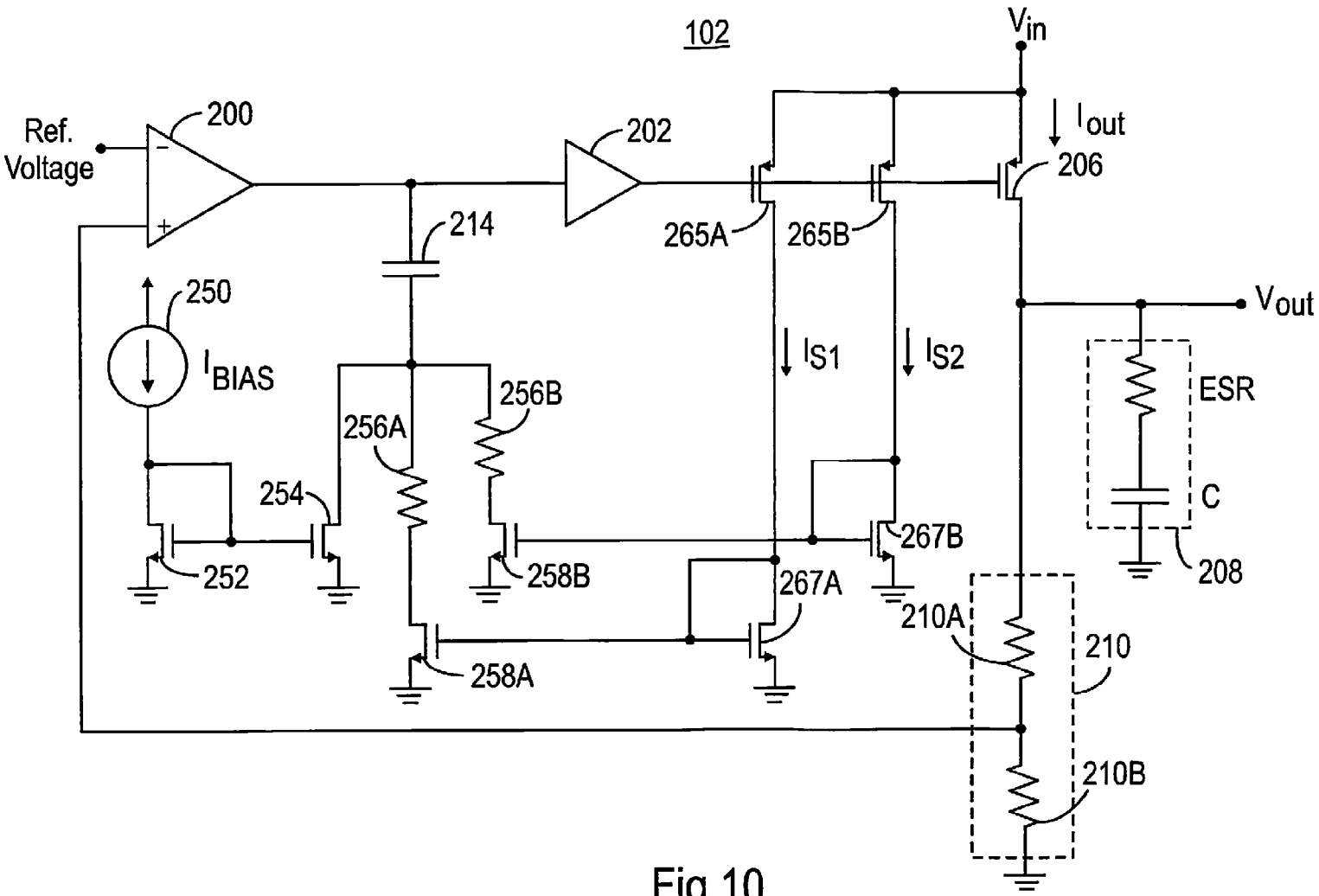
FIG. 10 depicts a more detailed circuit schematic of the LDO shown in FIG. 7.

FIG. 10 depicts a more detailed circuit schematic of LDO 102 shown in FIG. 7. The exemplary embodiment in FIG. 10 (or FIG. 7) extends the scheme discussed above with respect to FIG. 9 (or FIG. 6) by dividing the output current ($I_{out}$) into four intervals or ranges.

The embodiment in FIG. 10 includes the same components (with the same functionality), except for the addition of transistors 265B, 267B, and 258B, and resistor 256B. Similar to transistor 265A in FIG. 9, transistor 265B in FIG. 9 senses the output current ($I_{out}$), and provides a sensed current, $I_{S2}$. Furthermore, similar to transistors 267A and 258A described in connection with FIG. 10, transistors 267B and 258B form a current mirror. Little or no current flows through transistor 258B.

Consider the operation of LDO 102 in each of the four intervals of the output current ($I_{out}$). Assume that $R_{eq2}$ denotes the equivalent resistance for the internal zero, i.e., the parallel combination of three branches that include transistor 254; transistor 258A and resistor 256A; and transistor 258B and resistor 256B. In some implementations, the resistance of resistor 256A may be selected to be much larger than the effective resistance of transistor 254. The resistance of resistor 256A may be selected to be much larger than that of resistor 256B. In addition, Is1 is generally larger than Is2.

In the first interval, sensed currents $I_{S1}$ and $I_{S2}$ both have relatively small values and transistors 258A-258B operate in cut-off region. Consequently, the effective resistance of transistor 254 dominates $R_{eq2}$. By using appropriate dimensions for transistor 254, one may provide the desired phase margin.

In the second interval, the sensed current $I_{S1}$ has a large enough value to cause transistor 267A to operate in the saturation region (i.e., $V_{GS}>V_T$, where $V_T$ denotes the threshold voltage). Sensed current $I_{S2}$, however, has a relatively small value, such that transistor 258B and transistor 267B have relatively small gate-source voltages. Accordingly, the effective resistance of transistor 258A dominates $R_{eq2}$. By using appropriate dimensions for transistor 258A, one may provide the desired phase margin.

When the circuit operates in the third interval, sensed currents IS1 and IS2 both have relatively large values. Transistor 258A operates in strong inversion and it has a relatively small effective resistance as compared to the resistance of resistor 256A. Furthermore, transistor 258B operates in the saturation region while having an effective resistance much larger than that of the resistor 256A. Thus, the resistance of the resistor 256A tends to dominate Req2. By using an appropriate value for the resistor 256A, one may provide the desired phase margin.

In the fourth operating interval, sensed currents $I_{S1}$ and $I_{S2}$ both have large values (i.e., $I_{out}$ has a large value). In this case, both transistor 258A and transistor 258B have large gate-source voltages and, therefore, operate in strong inversion. Thus, transistor 258A and transistor 258B have smaller effective resistances than the respective resistances of resistor 256A and resistor 256B. In this scenario, the resistance of resistor 256B dominates $R_{eq2}$. By using an appropriate resistance value for resistor 25613, one may provide the desired phase margin.

Figure 11:
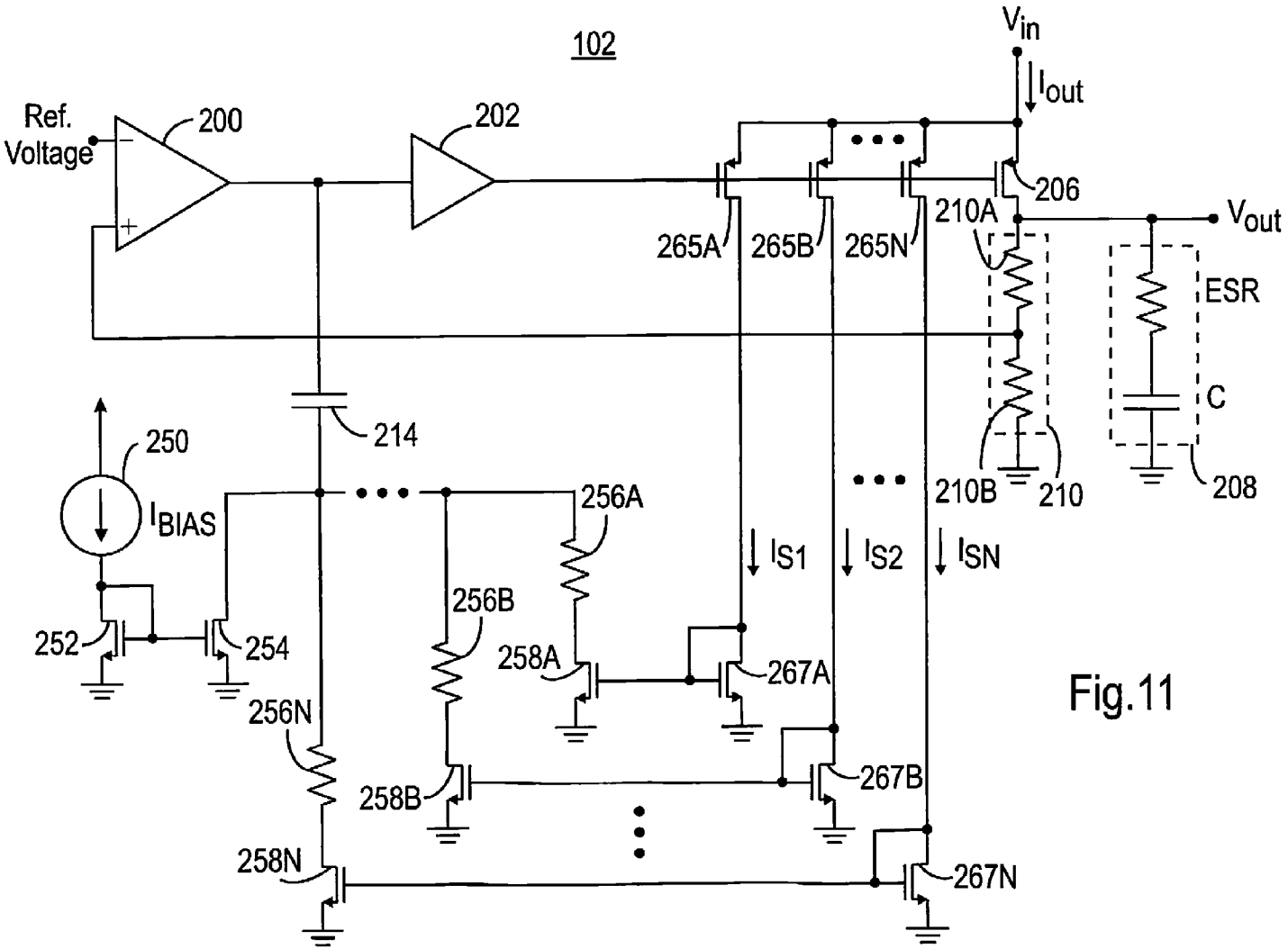
FIG. 11 shows a more detailed circuit schematic of the LDO shown in FIG. 8.

FIG. 11 shows a more detailed circuit schematic of LDO 102 shown in FIG. 8. In this exemplary embodiment, one may divide a relatively wide range for the output current ($I_{out}$) into a desired number of ranges. Put another way, one may implement N variable resistors to implement the internal zero, where the respective resistances of the N variable resistors change in response to N sensed currents, shown as currents $I_{S1}$-$I_{SN}$.

The embodiment shown in FIG. 11 is similar to the embodiment in FIG. 10, except that it includes additional transistors to provide N sensed currents ($I_{S1}$-$I_{SN}$), and additional transistors and resistors to provide N variable resistors. The operation of the embodiment in FIG. 11 will thus be apparent to persons of ordinary skill in the art who have the benefit of the description of the disclosed concepts.

Similar to the embodiments described above, by choosing appropriate dimensions for the transistors and resistance values for the resistors, one may provide the desired phase margin. By dividing the operation of LDO 102 into more intervals, one may provide a more refined compensation scheme to facilitate stable operation of LDO 102 under a relatively wide range of output currents.

As persons of ordinary skill in the art who have the benefit of the description of the disclosed concepts understand, one may apply the disclosed concepts effectively to various electronic circuits, using a variety of semiconductors and fabrication techniques. The examples described in this document constitute merely illustrative applications, and are not intended to limit the application of the disclosed concepts to other applications or implementations by making appropriate modifications. Those modifications fall within the knowledge and level of skill of persons of ordinary skill in the art who have the benefit of the description of the disclosed concepts.

Referring to the figures, persons of ordinary skill in the art will note that the various blocks shown might depict mainly the conceptual functions and signal flow. The actual circuit implementation might or might not contain separately identifiable hardware for the various functional blocks and might or might not use the particular circuitry shown. For example, one may combine the functionality of various blocks into one circuit block, as desired. Furthermore, one may realize the functionality of a single block in several circuit blocks, as desired. The choice of circuit implementation depends on various factors, such as particular design and performance specifications for a given implementation, as persons of ordinary skill in the art who have the benefit of the description of this disclosure understand. Other modifications and alternative embodiments in addition to those described here will be apparent to persons of ordinary skill in the art who have the benefit of this disclosure. Accordingly, this description teaches those skilled in the art the manner of carrying out the disclosed concepts and are to be construed as illustrative only.

The forms and embodiments shown and described should be taken as illustrative embodiments. Persons skilled in the art may make various changes in the shape, size and arrangement of parts without departing from the scope of the disclosed concepts in this document. For example, persons skilled in the art may substitute equivalent elements for the elements illustrated and described here. Moreover, persons skilled in the art who have the benefit of this disclosure may use certain features of the disclosed concepts independently of the use of other features, without departing from the scope of the disclosed concepts.

The invention claimed is:

1. A low-dropout converter having a transfer function, the low-dropout converter comprising:

a first transistor comprising (i) a control input and (ii) an output;

a capacitance comprising a first terminal and a second terminal, wherein the first terminal is connected between (i) the control input of the first transistor and (ii) an amplifier;

a first resistance connected to the second terminal of the capacitance, wherein the first resistance is a fixed resistance; and a second resistance connected in parallel with the first resistance and to the second terminal of the capacitance, wherein the second resistance is a variable resistance, wherein a location of a zero of the transfer function of the low-dropout converter is based on each of the capacitance, the first resistance, and the second resistance, the capacitance is connected between (i) the control input of the first transistor and (ii) the first resistance and the second resistance, the capacitance, the first resistance, and the second resistance are connected between (i) the control input of the first transistor and (ii) a ground reference, the capacitance, the first resistance, and the second resistance are not connected in series between (i) the amplifier and (ii) the control input of the transistor, the first resistance and the second resistance are connected between (i) the second terminal of the capacitance and (ii) the ground reference, and a voltage across the capacitance, the first resistance, and the second resistance is equal to an output voltage of the amplifier.

2. The low-dropout converter according to claim 1, wherein the location of the zero depends on a product of (i) a capacitance value of the capacitance and (ii) an equivalent resistance of the first resistance and the second resistance.

3. The low-dropout converter according to claim 1, wherein the first resistance comprises a first current mirror.

4. The low-dropout converter according to claim 3, wherein the first current mirror is configured to conduct a non-varying current.

5. The low-dropout converter according to claim 1, wherein the first resistance comprises a transistor.

6. The low-dropout converter according to claim 1, wherein the second resistance comprises a second current mirror.

7. The low-dropout converter according to claim 6, wherein the second current mirror is configured to conduct a current, wherein the current conducted by the second current mirror mirrors an output current of the low-dropout converter.

8. The low-dropout converter according to claim 7, wherein the second current mirror is connected to a current sensor.

9. The low-dropout converter according to claim 8, wherein the current sensor comprises a second transistor connected to the first transistor.

10. The low-dropout converter according to claim 1, wherein the second resistance comprises a third resistance connected to the first transistor, wherein the third resistance is a fixed resistance.

11. The low-dropout converter according to claim 1, wherein the capacitance is connected to at least one of a buffer and a driver, wherein the at least one of the buffer and the driver are connected between (i) the amplifier and (ii) the control input of the first transistor.

12. The low-dropout converter according to claim 11, further comprising the amplifier, wherein the amplifier is configured to compare a reference voltage to an output voltage of the low-dropout converter to generate an error signal, and wherein the output of the first transistor is at the output voltage of the low-dropout converter.

13. The low-dropout converter according to claim 12, wherein the amplifier is configured to drive the control input of the first transistor via the error signal.

14. A power converter comprising:

a transistor comprising (i) a control input and (ii) an output, wherein the output of the transistor is at an output voltage of the power converter;

an amplifier, wherein current out of the amplifier is directed to drive the control input of the transistor based on the output voltage of the power converter;

a fixed resistance; and a plurality of variable resistances, wherein the fixed resistance and the plurality of variable resistances are (i) are connected between the control input of the transistor and a ground reference, (ii) are connected between an output of the amplifier and the ground reference, and (iii) are connected in parallel with each other, wherein each of the fixed resistance and the plurality of variable resistances is configured to (i) stabilize an output voltage of the power converter, (ii) receive a portion of the current out of the amplifier, and (iii) divert the portion of the current out of the amplifier to the ground reference to prevent the portion of the current out of the amplifier from being received at the control input of the transistor, and wherein a resistance value of each of the plurality of variable resistances varies as a function of an output current of the power converter.

15. The power converter according to claim 14, further comprising a plurality of current sensors, wherein each of the plurality of current sensors is configured to sense the output current of the power converter.

16. The power converter according to claim 15, wherein each of the plurality of current sensors is configured to (i) detect a current supplied to an input of the transistor, and (ii) vary a resistance of a respective one of the plurality of variable resistances.

17. The power converter according to claim 16, wherein the varying of each of the plurality of variable resistances changes a location of a zero of a transfer function of the power converter.

18. The power converter according to claim 17, wherein the changing of the locations of the zeroes of the transfer function of the power converter stabilizes the output voltage of the power converter.

19. The power converter according to claim 14, wherein:

the plurality of variable resistances are connected to a capacitance; and the capacitance is connected (i) between the amplifier and the plurality of variable resistances, and (ii) between the control input of the transistor and the plurality of resistances.

20. The power converter according to claim 19, wherein a location of a zero of a transfer function of the power converter is based on a product of (i) a resistance value of the plurality of variable resistances, and (ii) a capacitance value of the capacitance.

21. The power converter according to claim 14, wherein the plurality of variable resistances are configured to stabilize the output voltage of the power converter in response to changes in the output current of the power converter.

22. The power converter according to claim 19, wherein the capacitance is connected, in series with each of the plurality of variable resistances, to an output of the amplifier.

23. The power converter according to claim 22, wherein the amplifier is configured to (i) compare a sample of the output voltage of the power converter with a reference voltage to generate a control signal, and (ii) drive the control input of the transistor of the power converter with the control signal.

24. A method comprising:

via an amplifier, driving a control input of a transistor of a power converter;

sampling an output current of the transistor to generate a plurality of samples, wherein output current of the power converter is equal to the output current of the transistor;

adjusting a zero location of a transfer function of the power converter including adjusting a resistance value of a first resistance based on the plurality of samples, wherein the first resistance is connected in series with a capacitance and in parallel with a second resistance, the second resistance is a fixed resistance, and the first resistance, the capacitance, and the second resistance are connected (i) between the control input of the transistor and a ground reference, and (ii) between an output of the amplifier and the ground reference;

receiving current from the amplifier via the first resistance and the second resistance; and outputting the current, received from the amplifier by the first resistance and the second resistance, to the ground reference.

25. The method according to claim 24, further comprising, based on a first sample from the plurality of samples of the output current of the power converter, adjusting a location of a zero of the transfer function of the power converter during a first time interval.

26. The method according to claim 25, further comprising, based on a second sample from the plurality of samples of the output current of the power converter, adjusting the transfer function of the power converter during a second time interval, wherein the second time interval is consecutively after the first time interval.

27. The method according to claim 24, further comprising adjusting resistance values of a plurality of resistances including the first resistance based on the plurality of samples of the output current of the power converter, wherein the plurality of resistances are connected between the control input of the transistor and the ground reference.

28. The method according to claim 27, wherein the adjusting of the resistance values of the plurality of resistances comprises changing the location of the zero of the transfer function of the power converter.

29. The method according to claim 24, wherein the sampling of the output current of the power converter comprises mirroring the output current of the power converter to generate the plurality of samples.

30. The method according to claim 29, further comprising scaling each sample in the plurality of samples of the output current of the power converter.

31. The low-dropout converter according to claim 1, wherein the capacitance, the first resistance and the second resistance are connected between an output of the amplifier and the ground reference.

32. The method according to claim 24, further comprising driving the control input of the transistor based on a comparison between an output voltage of the transistor and a reference voltage, wherein the reference voltage is different than a voltage of the ground reference.

33. The method according to claim 24, further comprising driving the control input of the transistor via the amplifier and based on the output voltage of the power converter.

34. The low-dropout converter of claim 1, wherein a voltage across the capacitance, the first resistance, and the second resistance relative to the ground reference is equal to an output voltage of the amplifier relative to the ground reference.

35. The low-dropout converter of claim 1, wherein the capacitance, the first resistance and the second resistance direct current from the amplifier to the ground reference.

36. The low-dropout converter of claim 1, wherein the first resistance and the second resistance are not connected between (i) the control input of the first transistor, and (ii) a second input of the first transistor.

37. The power converter of claim 14, wherein the plurality of variable resistances are not connected between (i) the control input of the transistor, and (ii) a second input of the transistor.

38. The method of claim 24, wherein the first resistance is not connected between (i) the control input of the transistor, and (ii) a second input of the transistor.

39. The method of claim 24, further comprising adjusting voltage at the control input of the transistor in response to the adjusting of the resistance value of the first resistance.

40. The low-dropout converter of claim 1, wherein the capacitance is connected in series with each of the first resistance and the second resistance.

41. The method of claim 24, wherein:

the capacitance is directly connected to an output of the amplifier; and the first resistance is directly connected to the ground reference.

42. The low-dropout converter of claim 1, wherein the second resistance is adjusted based on an output current of the transistor.

* * * * *